US011795662B2

(12) United States Patent
Iijima et al.

(10) Patent No.: US 11,795,662 B2
(45) Date of Patent: Oct. 24, 2023

(54) ENGINE CONTROL SYSTEM, WORK MACHINE, AND CONTROL METHOD FOR WORK MACHINE

(71) Applicant: Komatsu Ltd., Tokyo (JP)

(72) Inventors: Tadashi Iijima, Tokyo (JP); Tomoyuki Matsuda, Tokyo (JP); Keiichi Arai, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 17/634,565

(22) PCT Filed: Sep. 18, 2020

(86) PCT No.: PCT/JP2020/035387
§ 371 (c)(1),
(2) Date: Feb. 11, 2022

(87) PCT Pub. No.: WO2021/060170
PCT Pub. Date: Apr. 1, 2021

(65) Prior Publication Data

US 2022/0267995 A1 Aug. 25, 2022

(30) Foreign Application Priority Data

Sep. 26, 2019 (JP) ..... 2019-175182

(51) Int. Cl.
*E02F 9/22* (2006.01)
*F02D 29/04* (2006.01)
*F02D 41/30* (2006.01)

(52) U.S. Cl.
CPC ..... *E02F 9/2246* (2013.01); *F02D 29/04* (2013.01); *F02D 41/3011* (2013.01); *E02F 9/2225* (2013.01); *E02F 9/2296* (2013.01); *F02D 2200/0614* (2013.01); *F02D 2200/101* (2013.01)

(58) Field of Classification Search
CPC ..... F02D 29/04; F02D 41/3011; F02D 2200/0614; F02D 2250/38; E02F 9/2246; E02F 9/2296; E02F 9/2225
See application file for complete search history.

(56) References Cited

U.S. PATENT DOCUMENTS

2006/0118082 A1 6/2006 Nakamura et al.
2011/0167811 A1* 7/2011 Kawaguchi ..... F04B 49/065 60/395
2013/0090835 A1* 4/2013 Take ..... F02D 31/007 701/103
2014/0020375 A1* 1/2014 Fujishima ..... F02D 31/001 60/431

(Continued)

FOREIGN PATENT DOCUMENTS

EP 2682531 A1 * 1/2014 ..... E02F 9/2066
GB 2565429 A 2/2019

(Continued)

*Primary Examiner* — George C Jin

(57) ABSTRACT

An engine control system controls a work machine including an engine, a fuel injection device that injects fuel into the engine, and a hydraulic pump that is driven by the engine. The rotation state amount specification unit specifies a rotation state amount related to rotation of the engine. The injection amount determination unit determines a fuel injection amount by the fuel injection device based on the rotation state amount.

10 Claims, 6 Drawing Sheets

(56) References Cited

U.S. PATENT DOCUMENTS

| | | | | |
|---|---|---|---|---|
| 2015/0135693 | A1 | 5/2015 | Murakami et al. | |
| 2015/0275484 | A1* | 10/2015 | Ishihara | B60W 10/08 180/65.265 |
| 2016/0356021 | A1* | 12/2016 | Sugaya | E02F 9/2285 |
| 2017/0130428 | A1* | 5/2017 | Matsuzaki | E02F 9/2246 |

FOREIGN PATENT DOCUMENTS

| | | | | | |
|---|---|---|---|---|---|
| JP | 2004-011488 | A | | 1/2004 | |
| JP | 2005-016398 | A | | 1/2005 | |
| JP | 2010-048154 | A | | 3/2010 | |
| JP | 2014-125949 | A | | 7/2014 | |
| JP | 2014125949 | A | * | 7/2014 | |
| JP | 2017-122392 | A | | 7/2017 | |
| JP | 2017122392 | A | * | 7/2017 | F02D 1/02 |
| WO | 2014/192161 | A1 | | 12/2014 | |

* cited by examiner

ENGINE CONTROL SYSTEM, WORK MACHINE, AND CONTROL METHOD FOR WORK MACHINE

TECHNICAL FIELD

The present disclosure relates to an engine control system, a work machine, and a control method for the work machine.

Priority is claimed on Japanese Patent Application No. 2019-175182, filed Sep. 26, 2019, the content of which is incorporated herein by reference.

DESCRIPTION OF RELATED ART

Patent Literature 1 discloses a technique for temporarily increasing a maximum fuel injection amount when an engine rotation speed decreases with respect to an increase in an engine load in order to prevent the occurrence of black smoke and engine stall due to an increase in a hydraulic load in a low idle state.

PRIOR ART LITERATURE

Patent Literature

[Patent Literature 1] Japanese Unexamined Patent Application Publication No. 2010-048154

SUMMARY OF THE INVENTION

Problems to be Solved by the Invention

The technique disclosed in the Patent Literature 1 increases the maximum fuel injection amount when the rotation speed of the engine decreases. That is, when the fuel injection amount calculated by a governor exceeds the maximum fuel injection amount in the normal state, it is possible to drive the engine with a fuel injection amount larger than that in the normal state. Therefore, according to the technique disclosed in Patent Document 1, control equivalent to that in the normal state is performed until the fuel injection amount calculated by the governor exceeds the maximum fuel injection amount in the normal state, and there is a possibility that suppression of a decrease in the engine rotation speed may be delayed.

An object of the present disclosure is to provide an engine control system, a work machine, and a control method for the work machine that is capable of quickly suppressing a decrease in the rotation speed of the engine due to an increase in the hydraulic load.

Means for Solving the Problem

According to one aspect, an engine control system that controls a work machine including an engine, a fuel injection device that injects fuel into the engine, and a hydraulic pump that is driven by the engine, includes: a rotation state amount specification unit that is configured to specify a rotation state amount related to rotation of the engine, and an injection amount determination unit that is configured to determine a fuel injection amount by the fuel injection device based on the rotation state amount.

Effects of the Invention

According to at least one of the above-described aspects, the engine control system is capable of quickly suppressing a decrease in the rotation speed of the engine due to an increase in the hydraulic load.

MODE FOR CARRYING OUT THE INVENTION

First Embodiment

<<Configuration of Hydraulic Excavator>>

Figure 1:
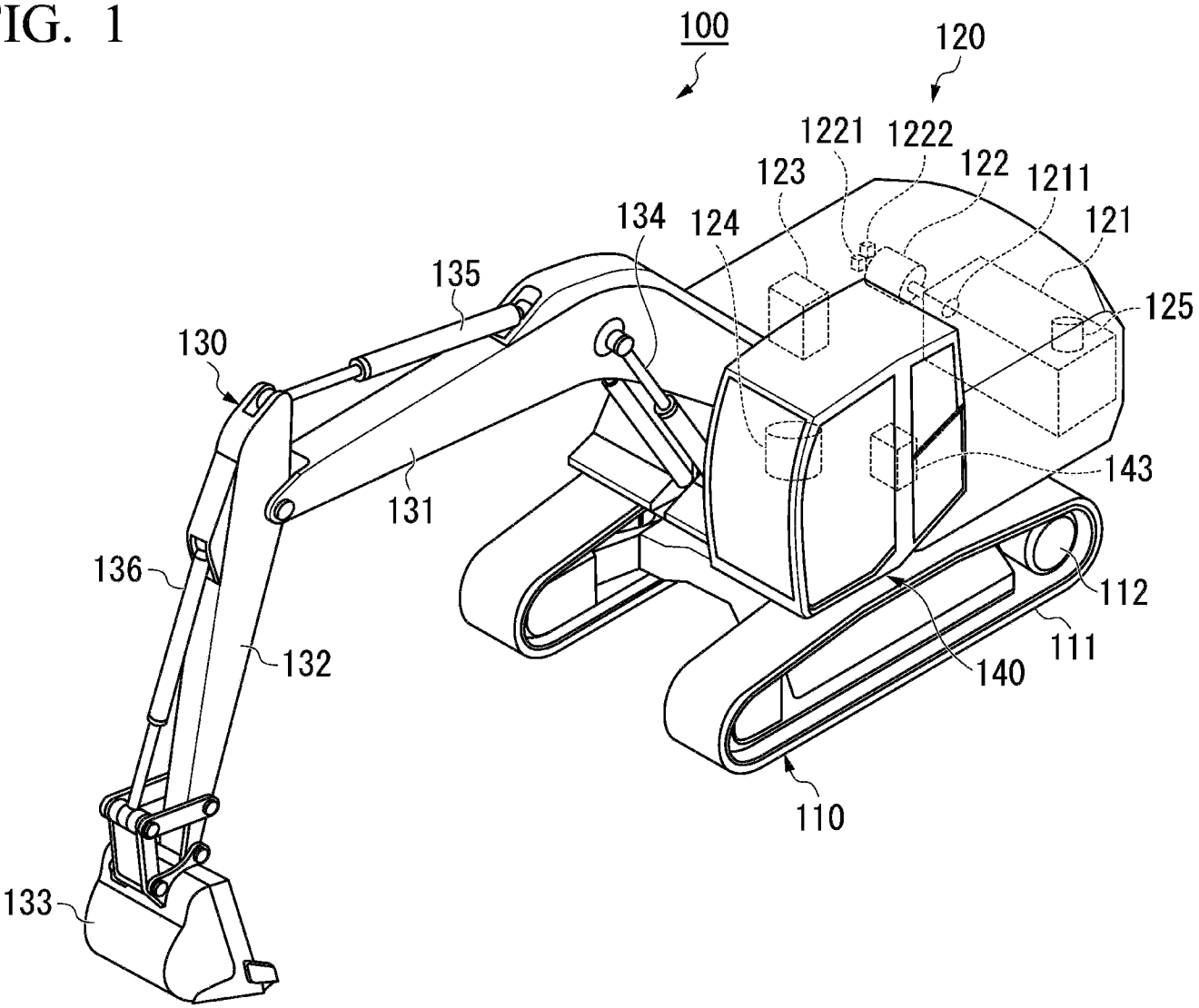
FIG. 1 is a schematic diagram illustrating a configuration of a work vehicle according to a first embodiment.

FIG. 1 is a schematic diagram illustrating a configuration of a work vehicle according to a first embodiment.

The hydraulic excavator 100 is a work vehicle that is operated at a construction site and used to perform construction of a construction target such as earth. The hydraulic excavator 100 includes a travel body 110, a swing body 120, work equipment 130, and an operator's cab 140.

The travel body 110 supports the hydraulic excavator 100 so as to be capable of traveling. The travel body 110 includes two endless tracks 111 provided on the left and right sides, and two travel motors 112 for driving each of the endless tracks 111.

The swing body 120 is supported by the travel body 110 so as to be capable of swinging about a swing center.

The work equipment 130 is driven by hydraulic pressure. The work equipment 130 is supported by a front portion of the swing body 120 so as to be capable of driving in a vertical direction.

The operator's cab 140 is a space for an operator to board and operate the hydraulic excavator 100. The operator's cab 140 is provided in a left front portion of the swing body 120.

<<Configuration of Swing Body>>

The swing body 120 includes an engine 121, a hydraulic pump 122, a control valve 123, a swing motor 124, and a fuel injection device 125.

The engine 121 is a prime mover that drives the hydraulic pump 122. The engine 121 is provided with a rotation speed sensor 1211 that measures the rotation speed Ne. The rotation speed sensor 1211 measures, for example, the rotation speed of a crankshaft of the engine 121.

The hydraulic pump 122 is a variable displacement pump driven by the engine 121. The hydraulic pump 122 supplies hydraulic oil to each actuator (a boom cylinder 134, an arm cylinder 135, a bucket cylinder 136, the travel motor 112, and the swing motor 124) via the control valve 123. The hydraulic pump 122 is provided with a pressure sensor 1221 that measures pressure of hydraulic oil and a capacity sensor 1222 that measures capacity of the hydraulic pump 122. The capacity sensor 1222 measures, for example, an angle of a swash plate of the hydraulic pump 122, a movement amount of the swash plate, or a movement amount of a servo piston that presses the swash plate, and converts it into capacity of the hydraulic pump 122.

The control valve 123 controls a flow rate of hydraulic oil supplied from the hydraulic pump 122.

The swing motor 124 is driven by hydraulic oil supplied from the hydraulic pump 122 via the control valve 123 to swing the swing body 120.

The fuel injection device 125 receives a fuel instruction based on an operation amount of the fuel injection amount control device 1427 from an engine control system 143 described later, and injects fuel of a fuel injection amount according to the fuel instruction to the engine 121.

<<Configuration of Work Equipment>>

A work equipment 130 includes a boom 131, an arm 132, a bucket 133, the boom cylinder 134, the arm cylinder 135, and the bucket cylinder 136.

The base end portion of the boom 131 is attached to swing body 120 via a pin.

An arm 132 connects the boom 131 and the bucket 133. The base end portion of the arm 132 is attached to the tip end portion of the boom 131 via a pin.

The bucket 133 includes teeth for excavating earth and an accommodation portion for accommodating the excavated earth. The base end portion of the bucket 133 is attached to the tip end portion of the arm 132 via a pin.

The boom cylinder 134 is a hydraulic cylinder for operating the boom 131. A base end portion of the boom cylinder 134 is attached to the swing body 120. The tip end portion of the boom cylinder 134 is attached to the boom 131.

The arm cylinder 135 is a hydraulic cylinder for driving the arm 132. A base end portion of the arm cylinder 135 is attached to the boom 131. The tip end portion of the arm cylinder 135 is attached to the arm 132.

The bucket cylinder 136 is a hydraulic cylinder for driving the bucket 133. A base end portion of the bucket cylinder 136 is attached to the arm 132. A tip end portion of the bucket cylinder 136 is attached to a link member connected to the bucket 133.

<<Configuration of Operator's Cab>>

Figure 2:
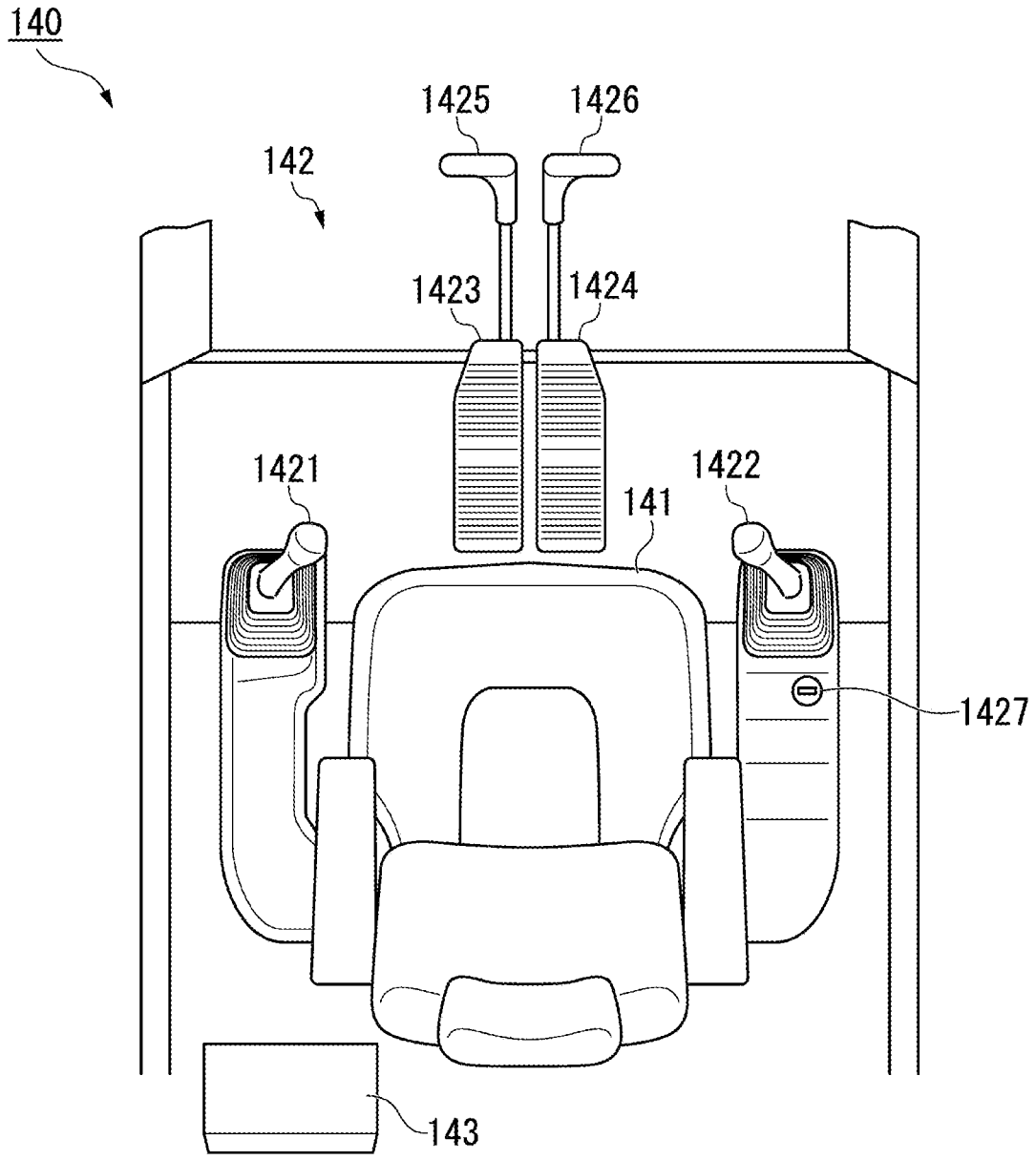
FIG. 2 is a diagram illustrating an internal configuration of an operator's cab according to the first embodiment.

FIG. 2 is a diagram illustrating an internal configuration of the operator's cab according to the first embodiment.

An operator's seat 141, an operation device 142, and an engine control system 143 are provided in the operator's cab 140.

The operation device 142 is an interface for driving the travel body 110, the swing body 120, and the work equipment 130 by a manual operation of an operator. The operation device 142 includes a left operation lever 1421, a right operation lever 1422, a left foot pedal 1423, a right foot pedal 1424, a left travel lever 1425, a right travel lever 1426, and a fuel injection amount control device 1427.

The left operation lever 1421 is provided on the left side of the operator's seat 141. The right operation lever 1422 is provided on the right side of the operator's seat 141.

The left operation lever 1421 is an operation mechanism for performing a swing operation of the swing body 120 and a pulling and pushing operation of the arm 132. Specifically, when the operator of the hydraulic excavator 100 tilts the left operation lever 1421 forward, the arm 132 performs a pushing operation. When the operator of the hydraulic excavator 100 tilts the left operation lever 1421 rearward, the arm 132 performs a pulling operation. When an operator of the hydraulic excavator 100 tilts the left operation lever 1421 rightward, the swing body 120 swings to the right. When an operator of the hydraulic excavator 100 tilts the left operation lever 1421 leftward, the swing body 120 swings to the left. In another embodiment, the swing body 120 may swing to the right or to the left when the left operation lever 1421 is tilted in the front-rear directions, and the arm 132 may perform a dumping operation or an excavating operation when the left operation lever 1421 is tilted in the left-right directions.

The right operation lever 1422 is an operation mechanism for performing an excavating and dumping operation of the bucket 133 and a raising and lowering operation of the boom 131. Specifically, when the operator of the hydraulic excavator 100 tilts the right operation lever 1422 forward, a lowering operation of the boom 131 is performed. Further, when the operator of the hydraulic excavator 100 tilts the right operation lever 1422 rearward, a raising operation of the boom 131 is performed. Further, when the operator of the hydraulic excavator 100 tilts the right operation lever 1422 rightward, a dumping operation of the bucket 133 is performed. Further, when the operator of the hydraulic excavator 100 tilts the right operation lever 1422 leftward, an excavating operation of the bucket 133 is performed.

The left foot pedal 1423 is disposed on the left side of the floor surface in front of the operator's seat 141. The right foot pedal 1424 is disposed on the right side of the floor surface in front of the operator's seat 141. The left travel lever 1425 is pivotally supported by the left foot pedal 1423, and is configured such that an inclination of the left travel lever 1425 and the depression of the left foot pedal 1423 are linked. The right travel lever 1426 is pivotally supported by the right foot pedal 1424, and is configured such that an inclination of the right travel lever 1426 and the depression of the right foot pedal 1424 are linked.

The left foot pedal 1423 and the left travel lever 1425 correspond to the rotational drive of the left crawler of the travel body 110. Specifically, when the operator of the hydraulic excavator 100 presses the left foot pedal 1423 or tilts the left travel lever 1425 forward, the left crawler rotates in a forward direction. Further, when the operator of the hydraulic excavator 100 presses the left foot pedal 1423 or tilts the left travel lever 1425 rearward, the left crawler rotates in a rearward direction.

The right foot pedal 1424 and the right travel lever 1426 correspond to rotational driving of the right crawler of the travel body 110. Specifically, when the operator of the hydraulic excavator 100 presses the right foot pedal 1424 or tilts the right travel lever 1426 forward, the right crawler rotates in the forward direction. Further, when the operator of the hydraulic excavator 100 presses the right foot pedal 1424 or tilts the right travel lever 1426 rearward, the right crawler rotates in the rearward direction.

The fuel injection amount control device 1427 is an input device for instructing the rotation speed of the engine 121. For example, the fuel injection amount control device 1427 may be a dial that is rotated by the operator, and an instruction position may be determined stepwise by a notch. The instruction position of the fuel injection amount control device 1427 is set in a range from MIN to MAX. The instruction position MIN indicates an instruction to set the rotation of the engine 121 to low idle rotation, and the closer the instruction position is to MAX indicates an instruction to set a higher target value of the rotation speed of the engine 121. Hereinafter, the instruction position by the fuel injection amount control device 1427 is referred to as an operation amount of the fuel injection amount control device 1427. In addition, the fuel injection amount control device 1427 according to another embodiment may be realized by a configuration other than a dial, such as a lever.

<<Configuration of Engine Control System>>

Figure 3:
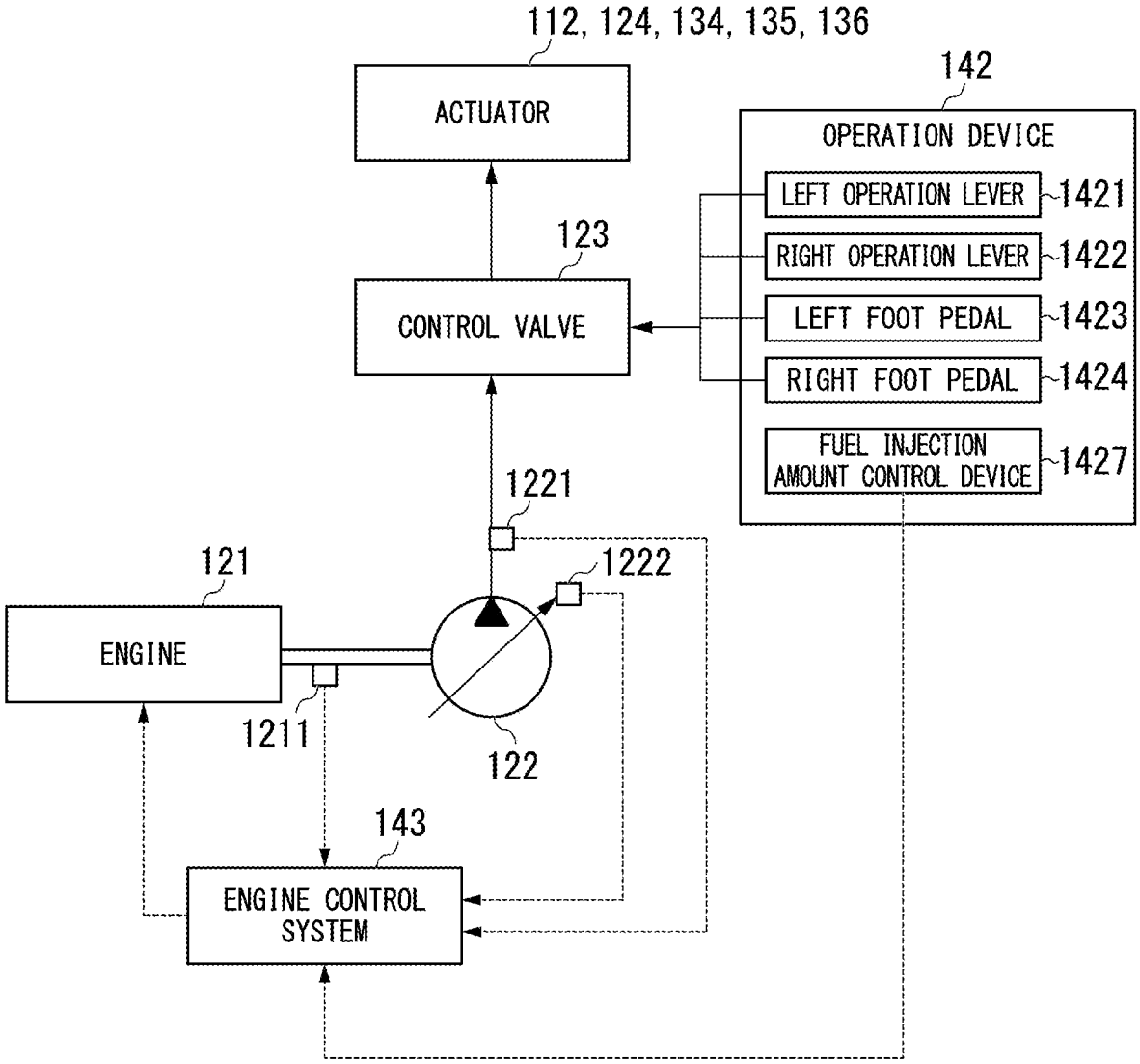
FIG. 3 is a schematic block diagram illustrating a configuration of an engine control system according to the first embodiment.
Figure 4:
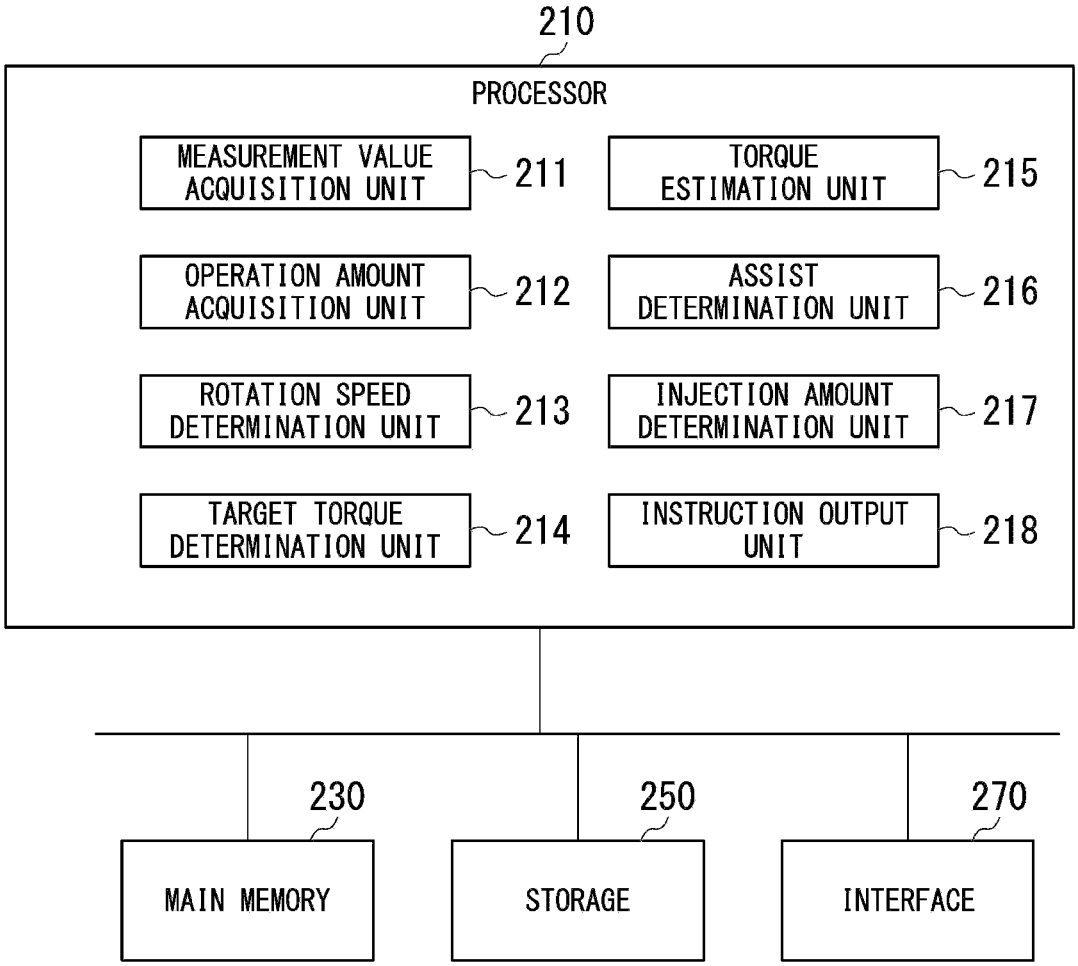
FIG. 4 is a schematic block diagram illustrating a relationship between the engine control system and a power system of a hydraulic excavator according to the first embodiment.

FIG. 3 is a schematic block diagram showing the relationship between the engine control system and a power system of the hydraulic excavator according to the first embodiment. FIG. 4 is a schematic block diagram showing the configuration of the engine control system according to the first embodiment. Hereinafter, the configuration of the engine control system will be described with reference to FIGS. 3 and 4.

The engine control system 143 acquires measurement values from the rotation speed sensor 1211, the pressure sensor 1221, and the capacity sensor 1222, and outputs a fuel injection amount instruction to the engine 121.

The engine control system 143 is a computer including a processor 210, a main memory 230, a storage 250, and an interface 270.

The storage 250 is a non-transitory tangible storage medium. Examples of the storage 250 include a magnetic disk, a magneto-optical disk, an optical disk, a semiconductor memory, and the like. The storage 250 may be an internal medium directly connected to a bus of the engine control system 143, or may be an external medium connected to the engine control system 143 via the interface 270 or a communication line. The storage 250 stores a program for controlling the engine 121.

The program may be intended to realize some of the functions exerted by the engine control system 143. For example, the program may exert a function in combination with another program already stored in the storage 250 or in combination with another program installed in another device. In another embodiment, the engine control system 143 may include a custom large-scale integrated circuit (LSI) such as a programmable logic device (PLD) in addition to or instead of the above-described configuration. Examples of the PLD include a programmable array logic (PAL), a generic array logic (GAL), a complex programmable logic device (CPLD), and a field-programmable gate array (FPGA). In this case, some or all of the functions implemented by the processor may be implemented by the integrated circuit.

The processor 210 executes a program to function as a measurement value acquisition unit 211, an operation amount acquisition unit 212, a rotation speed determination unit 213, a target torque determination unit 214, a torque estimation unit 215, an assist determination unit 216, an injection amount determination unit 217, and an instruction output unit 218.

The measurement value acquisition unit 211 acquires measurement values from the rotation speed sensor 1211, the pressure sensor 1221, and the capacity sensor 1222.

The operation amount acquisition unit 212 acquires an operation amount from the fuel injection amount control device 1427 of the operation device 142. In addition, the operation amounts of the left operation lever 1421, the right operation lever 1422, the left foot pedal 1423, and the right foot pedal 1424 of the operation device 142 are input to the control valve 123 without going through the engine control system 143.

The rotation speed determination unit 213 determines a target value of the rotation speed of the engine 121 based on the operation amount of the fuel injection amount control device 1427. For example, the rotation speed determination unit 213 calculates a target value of the rotation speed of the engine 121 from the operation amount of the fuel injection amount control device 1427 based on a relationship function in which the target value of the rotation speed monotonically increases with respect to the operation amount.

The target torque determination unit 214 determines a target value of the engine torque (target torque) based on the measurement value Ne of the rotation speed sensor 1211 such that the rotation speed of the engine 121 approaches the target value determined by the rotation speed determination unit 213. The target torque determination unit 214 determines a target value of the engine torque by, for example, all-speed control type governor calculation.

The torque estimation unit 215 estimates an inertia torque $T_{inert}$ of a mass point system including the engine 121 and the hydraulic pump 122 (that is, a structure including the engine 121 and the hydraulic pump 122) and an absorption torque Te of the hydraulic pump 122 based on measurement values of the rotation speed sensor 1211, the pressure sensor 1221, and the capacity sensor 1222. The inertia torque $T_{inert}$ is an example of a rotation state amount related to rotation of the engine 121. That is, the torque estimation unit 215 is an example of a rotation state amount specification unit that specifies the rotation state amount. Further, the torque estimation unit 215 is an example of an absorption torque specification unit.

The assist determination unit 216 determines whether or not to add an assist torque for suppressing a decrease in the rotation speed of the engine 121 to the target value of the engine torque based on the inertia torque $T_{inert}$ calculated by the torque estimation unit 215. In addition, the assist determination unit 216 determines the value of the assist torque based on the inertia torque $T_{inert}$.

The injection amount determination unit 217 determines the fuel injection amount based on the target value of the engine torque.

The instruction output unit 218 outputs a fuel instruction indicating the fuel injection amount calculated by the injection amount determination unit 217 to the fuel injection device 125.

<<Operation of Engine Control System>>

Figure 5:
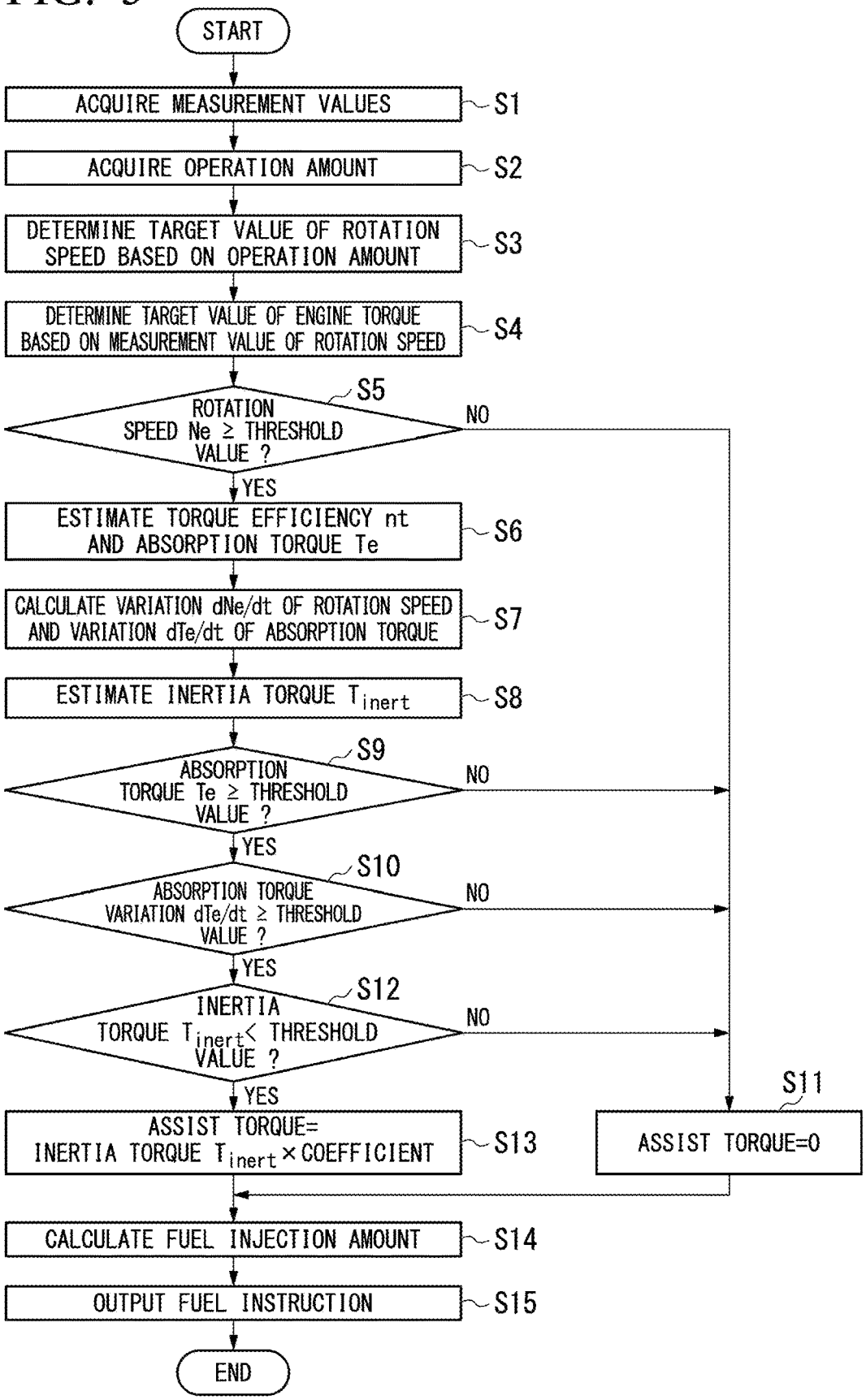
FIG. 5 is a flowchart illustrating an operation of the engine control system according to the first embodiment.

FIG. 5 is a flowchart illustrating an operation of the engine control system according to the first embodiment. Hereinafter, the operation of the engine control system will be described with reference to FIGS. 3 to 5.

When the engine 121 starts driving, the measurement value acquisition unit 211 of the engine control system 143 acquires measurement values from the rotation speed sensor 1211, the pressure sensor 1221, and the capacity sensor 1222 (step S1). The operation amount acquisition unit 212 acquires an operation amount of the fuel injection amount control device 1427 (step S2).

Next, the rotation speed determination unit 213 determines a target value of the rotation speed of the engine 121 based on the operation amount of the fuel injection amount control device 1427 acquired in step S2 (step S3). Next, the target torque determination unit 214 determines a target value of the engine torque based on the measurement value Ne of the rotation speed sensor 1211 (step S4). For example, the target torque determination unit 214 calculates a difference between the target value of the rotation speed determined in step S3 and the measurement value Ne of the rotation speed sensor 1211 acquired in step S1 as the rotation deviation. For example, the target torque determination unit 214 calculates a target value of the engine torque by multiplying the rotation deviation by a gain.

Next, the torque estimation unit 215 determines whether or not the rotation speed Ne of the engine 121 is equal to or higher than a predetermined rotation speed threshold value (step S5). The rotation speed threshold value is, for example, 0 or a positive number close to 0. In other words, the torque estimation unit 215 determines whether the engine 121 is rotating. When the rotation speed Ne of the engine 121 is less than the rotation speed threshold value (step S5: NO), the assist determination unit 216 sets the assist torque to 0 (step S11). That is, the assist determination unit 216 determines not to add the assist torque to the target value of the engine torque.

On the other hand, when the rotation speed Ne of the engine 121 is equal to or higher than the rotation speed threshold value (step S5: YES), the torque estimation unit 215 estimates the torque efficiency nt and the absorption torque Tc of the hydraulic pump 122 from the measurement values of the pressure sensor 1221 and the capacity sensor 1222 (step S6). The absorption torque Te of the hydraulic pump 122 can be obtained by the following Equation (1), for example.

$$Te=(q\times P)/(2\times\pi\times nt) \quad (1)$$

q is a measurement value of the capacity sensor 1222. P is a measurement value of the pressure sensor 1221.

The torque estimation unit 215 differentiates the measurement value Ne of the rotation speed sensor 1211 and the absorption torque Te to calculate a variation dNe/dt of the rotation speed and a variation dTe/dt of the absorption torque (step S7). At this time, the torque estimation unit 215 removes noise by applying a low-pass filter to the calculated variation dNe/dt of the rotation speed and the calculated variation dTe/dt of the absorption torque. Examples of the low-pass filter include a moving average filter. The torque estimation unit 215 estimates the inertia torque $T_{inert}$ of a mass system including the engine 121 and the hydraulic pump 122 based on the variation dNe/dt of the rotation speed obtained in step S7 (step S8).

The inertia torque $T_{inert}$ can be obtained by, for example, the following Equation (2).

$$T_{inert}=2\pi/60\times I\times dNe/dt \quad (2)$$

I is the inertia moment of the mass point system including the engine 121 and the hydraulic pump 122. The moment of inertia I can be obtained in advance. dNe/dt is a variation dNe/dt of the rotation speed of the engine 121 calculated in step S7. The inertia torque $T_{inert}$ takes a positive value when the rotation of the engine 121 is increasing, and takes a negative value when the rotation of the engine 121 is decreasing.

Next, the assist determination unit 216 determines whether or not the absorption torque Te of the hydraulic pump 122 estimated in step S6 is equal to or higher than a predetermined absorption torque threshold value (step S9). When the absorption torque Te is equal to or higher than the absorption torque threshold value (step S9: YES), the assist determination unit 216 determines whether or not the variation dTe/dt of the absorption torque of the hydraulic pump 122 calculated in step S7 is equal to or higher than a predetermined torque variation threshold value (step S10). The absorption torque threshold value and the torque variation threshold value respectively correspond to an absorption torque Te and a variation dTe/dt of the absorption torque when a sudden load is applied to the work equipment 130. Therefore, the assist determination unit 216 is capable of determining whether or not a sudden load is applied to the work equipment 130 based on the determination of step S9 and step S10. When the absorption torque Te is less than the absorption torque threshold value (step S9: NO) or when the variation dTe/dt of the absorption torque is less than the torque variation threshold value (step S10: NO), the assist determination unit 216 sets the assist torque to 0 (step S11) because a sudden load is not applied to the work equipment 130. In other words, the assist determination unit 216 determines not to add the assist torque to the target value of the engine torque.

When the variation dTe/dt of the absorption torque of the hydraulic pump 122 is equal to or higher than the predetermined torque variation threshold value (step S10: YES), the assist determination unit 216 determines whether the inertia torque $T_{inert}$ estimated in step S8 is less than the predetermined inertia torque threshold value (step S12). The inertia torque threshold value is 0 or a negative value. The inertia torque threshold value may be set with hysteresis. In this case, for example, a lower threshold value of the hysteresis takes a value corresponding to the inertia torque $T_{inert}$ of the sudden load, and an upper threshold value of the hysteresis takes a positive value, 0, or a negative value close to 0. In a case where the inertia torque threshold value does not have hysteresis, hunting of the engine rotation speed is likely to occur because the frequency of switching between the presence and absence of assist torque described later increases when the inertia torque $T_{inert}$ slightly changes in the vicinity of the inertia torque threshold value. Therefore, it is possible to prevent the occurrence of hunting of the engine rotation speed by providing the inertia torque threshold value with hysteresis.

When the inertia torque $T_{inert}$ is less than the inertia torque threshold value (step S12: YES), the assist determination unit 216 determines the assist torque by multiplying the inertia torque $T_{inert}$ estimated in step S8 by a predetermined coefficient (step S13). The coefficient by which the inertia torque $T_{inert}$ is multiplied is a value less than 0. In other words, the assist torque is a positive value. Accordingly, the assist determination unit 216 determines the assist torque so as to cancel out the decrease amount of the inertia torque $T_{inert}$.

On the other hand, in a case where the inertia torque $T_{inert}$ is equal to or higher than the inertia torque threshold value (step S12: NO), the assist determination unit 216 sets the assist torque to 0 (step S11) because a decrease in the rotation speed due to a sudden load has not occurred. In other words, the assist determination unit 216 determines not to add the assist torque to the target value of the engine torque.

The injection amount determination unit 217 adds the value of the assist torque determined in step S11 or step S13 to the target value of the engine torque calculated in step S4, and calculates the fuel injection amount based on the addition (step S14). At this time, the injection amount determination unit 217 provides a limiter so that the fuel injection amount does not exceed an oxygen to fuel control (OFC) threshold value. The OFC threshold value is a threshold value for limiting the fuel injection amount so that the air-fuel ratio is biased to the rich side and black smoke is not generated. In addition, the OFC threshold value may change depending on the state of a turbocharger (not shown). Further, the fuel injection amount determined by the injection amount determination unit 217 is limited by a maximum injection amount corresponding to the rotation speed of the engine 121.

The instruction output unit 218 outputs a fuel instruction indicating the fuel injection amount calculated in step S14 to the fuel injection device 125 (step S15).

<<Operation and Effects>>

Figure 6:
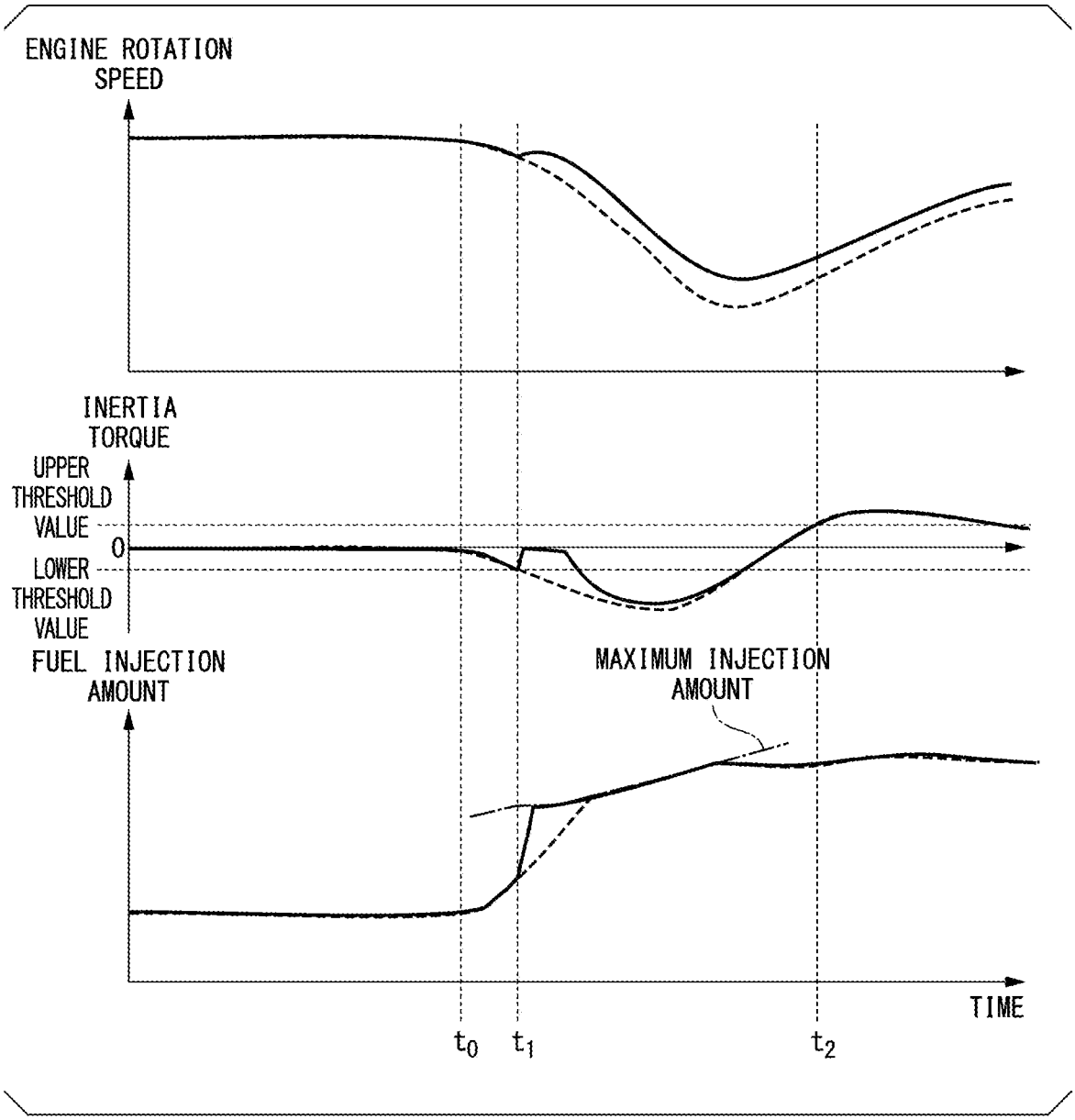
FIG. 6 is a diagram illustrating an operation example of the engine control system according to the first embodiment.

FIG. 6 is a diagram illustrating an operation example of the engine control system according to the first embodiment.

In FIG. 6, transitions of the rotation speed Ne of the engine 121, the inertia torque $T_{inert}$, and the fuel injection amount when the engine control system 143 according to the first embodiment operates under a certain circumstance are indicated by solid lines. Hereinafter, an operation and an effect of the engine control system 143 according to the first embodiment will be described with reference to FIG. 6.

When a sudden load of the work equipment 130 occurs at the time t0, the rotation speed Ne of the engine 121 starts to decrease. At this time, the variation dNe/dt of the rotation speed decreases, and thus the inertia torque $T_{inert}$ starts to decrease from a value in the vicinity of 0 according to Equation (2). When the rotation speed Ne of the engine 121 decreases, the target value of the engine torque determined in step S4 increases because the difference from the target value of the rotation speed increases, and thus the fuel injection amount calculated in step S14 also increases. On the other hand, during a period from the time t0 to the time t1, the value of the inertia torque $T_{inert}$ is equal to or higher than the lower threshold value of the hysteresis related to the inertia torque threshold value compared in step S12, and thus the value of the assist torque is 0. As described above, the inertia torque threshold value has hysteresis. Thus, in a case where the value of the inertia torque $T_{inert}$ decreases from a value higher than the upper threshold value of the hysteresis, the engine control system 143 compares the value of the inertia torque $T_{inert}$ with the lower threshold of the hysteresis. On the other hand, in a case where the value of the inertia torque $T_{inert}$ increases from a value less than the lower threshold value of the hysteresis, the engine control system 143 compares the value of the inertia torque $T_{inert}$ with the upper threshold value of the hysteresis.

At the time t1, the value of the inertia torque $T_{inert}$ becomes less than the lower threshold value of the hysteresis related to the inertia torque threshold value. As a result, the engine control system 143 calculates the assist torque corresponding to a magnitude of the inertia torque $T_{inert}$ in step S13. As a result, the fuel injection amount calculated in step S14 greatly increases. By greatly increasing the fuel injection amount, it is possible to suppress a decrease in the engine rotation speed after the time t1 and quickly bring the engine rotation speed close to the target value. However, even when the assist torque is added, the fuel injection amount is limited by a maximum injection amount defined by the rotation speed Ne of the engine 121. In FIG. 6, the transition of the maximum injection amount is indicated by a one dot chain line.

Thereafter, at the time t2, the value of the inertia torque $T_{inert}$ becomes equal to or higher than the upper threshold value of the hysteresis related to the inertia torque threshold value. Thereafter, the assist torque by the engine control system 143 becomes 0.

In addition, in FIG. 6, as a comparative example, transitions in the rotation speed Ne of the engine 121, the inertia torque $T_{inert}$, and the fuel injection amount in a case where the assist torque is not added are indicated by broken lines.

During the period from the time t0 to the time t1, both the control by the engine control system 143 according to the first embodiment and the control according to the comparative example follow the same transitions because the value of the assist torque is 0.

On the other hand, when the time t1 is reached and the value of the inertia torque $T_{inert}$ becomes less than the lower threshold value of the hysteresis related to the inertia torque, the assist torque is not added in the control in the comparative example, and thus the increase amount of the fuel injection amount becomes slow as compared with the control by the engine control system 143 according to the first embodiment. As a result of the increase amount of the fuel injection amount becoming slow, the decrease of the engine rotation speed cannot be suppressed early even after the time t1, and the recovery of the rotation speed is delayed.

As described above, the engine control system 143 according to the first embodiment specifies the inertia torque $T_{inert}$ which is the rotation state amount related to the rotation of the engine 121, and determines the fuel injection amount by the fuel injection device 125 based on the inertia torque $T_{inert}$. The absolute value of the inertia torque $T_{inert}$ increases in connection with the load applied to the work equipment 130. Therefore, by determining the fuel injection amount based on the inertia torque $T_{inert}$, the engine control system 143 can appropriately cancel the decrease in the rotation speed Ne of the engine 121 due to the load.

In addition, the engine control system 143 according to the first embodiment determines the fuel injection amount based on the inertia torque $T_{inert}$; however, it is not limited to this in another embodiment, and the fuel injection amount may be determined by using another rotation state amount instead of the inertia torque $T_{inert}$. For example, as shown in the above equation (2), the inertia torque $T_{inert}$ is obtained from the moment of inertia I of a mass system including the engine 121 and the hydraulic pump 122 and the variation dNe/dt of the rotation speed of the engine 121. In the equation (2), the moment of inertia I is a constant. Therefore, in another embodiment, the fuel injection amount may be determined using only the variation dNe/dt of the rotation speed of the engine 121 instead of the inertia torque $T_{inert}$. The variation dNe/dt of the rotation speed of the engine 121 can also be said to be an example of the rotation state amount.

In addition, the engine control system 143 according to the first embodiment sets the assist torque to 0 when the inertia torque $T_{inert}$ is equal to or higher than the lower threshold value of the hysteresis related to the inertia torque that is a negative number, and calculates the assist torque by multiplying the inertia torque $T_{inert}$ by a predetermined coefficient when the inertia torque $T_{inert}$ is less than the lower side of the hysteresis related to the inertia torque threshold value. Accordingly, the engine control system 143 is capable of increasing the assist torque as the inertia torque $T_{inert}$ increases, that is, as the load applied to the work equipment 130 increases. On the other hand, in another embodiment, the present invention is not limited thereto, and the assist torque in a case where the inertia torque $T_{inert}$ is less than the lower threshold value of the hysteresis related to the inertia torque may be set as a positive constant.

Further, the engine control system 143 according to the first embodiment specifies the absorption torque Te in the hydraulic pump 122 and determines the fuel injection amount based on the absorption torque Te and the inertia torque $T_{inert}$. The absorption torque Te of the pump increases when a load is applied to the work equipment 130. Therefore, according to the first embodiment, it is possible to prevent the fuel injection amount from increasing in a case where an increase in the inertia torque $T_{inert}$ does not depend on the occurrence of a sudden load, such as a failure or disturbance of the engine 121.

In addition, in another embodiment, the fuel injection amount may be determined without using the absorption torque Te. At this time, the engine control system 143 can prevent the fuel injection amount from being increased when the increase in the inertia torque $T_{inert}$ does not depend on the occurrence of a sudden load by determining whether or not the work equipment 130 is driven based on, for example, the operation amount of the operation device 142.

The engine control system 143 according to the first embodiment determines a target value of the engine torque in accordance with the operation amount of the fuel injection amount control device 1427 of the operation device 142, and adds a predetermined assist torque to the target value of the engine torque when the inertia torque $T_{inert}$ is less than the inertia torque threshold value. As a result, the engine control system 143 can further add the fuel injection amount for suppressing the decrease of the rotation speed Ne to the fuel injection amount determined by the normal engine control.

Another Embodiment

Although one embodiment has been described in detail with reference to the drawings, the specific configuration is not limited to that described above, and various design changes and the like can be made. That is, in another embodiment, the order of the above-described processes may be changed as appropriate. In addition, some of the processes may be executed in parallel.

The engine control system 143 according to the above-described embodiment may be configured by a single computer, or the configuration of the engine control system 143 may be divided into a plurality of computers and the plurality of computers may cooperate with each other to function as the engine control system 143.

The engine control system 143 according to the above-described embodiment estimates the inertia torque $T_{inert}$ by Equation (1) based on the pressure and capacity of the hydraulic oil output by the hydraulic pump 122. On the other hand, the hydraulic pump 122 supplies hydraulic oil to a plurality of actuators including the travel motor 112 and the swing motor 124. Therefore, in another embodiment, a flow rate sensor may be provided in each actuator, and the engine control system 143 may specify a proportion of the output of the hydraulic pump 122 used for driving the work equipment 130 based on the measurement value of the flow rate sensor and estimate the inertia torque $T_{inert}$ in consideration of the proportion. Similarly, the other engine control system 143 may estimate the absorption torque Te of the hydraulic pump 122 in consideration of the proportion.

Although the inertia torque threshold value according to the above-described embodiment has hysteresis, the inertia torque threshold value according to another embodiment may not have hysteresis.

In the above-described embodiment, the case where the engine control system 143 is provided in the hydraulic excavator 100 has been described; however, the engine control system 143 according to another embodiment may be provided in other work machines such as a wheel loader, a motor grader, or a bulldozer.

INDUSTRIAL APPLICABILITY

According to the above disclosure, the engine control system can quickly suppress a decrease in the rotation speed of the engine due to an increase in the hydraulic load.

BRIEF DESCRIPTION OF THE REFERENCE SYMBOLS

100: Hydraulic Excavator
110: Travel Body
111: Endless Track
112: Travel Motor
120: Swing Body
121: Engine
1211: Rotation Speed Sensor
122: Hydraulic pump
1221: Pressure Sensor
1222: Capacity Sensor
123: Control Valve
124: Swing Motor
125: Fuel Injection Device
130: Work Equipment
131: Boom
132: Arm
133: Bucket
134: Boom Cylinder
135: Arm Cylinder
136: Bucket Cylinder
140: Operator's Cab
141: Operator's Seat
142: Operation Device
1421: Left Operation Lever
1422: Right Operation Lever
1423: Left Foot Pedal
1424: Right Foot Pedal
1425: Left travel lever
1426: Right Travel Lever
143: Engine Control System
210: Processor
211: Measurement Value Acquisition Unit
212: Operation Amount Acquisition Unit
213: Rotation Speed Determination Unit
214: Target Torque Determination Unit
215: Torque Estimation Unit
216: Assist Determination Unit
217: Injection Amount Determination Unit
218: Instruction Output Unit
230: Main Memory
250: Storage
270: Interface

The invention claimed is:

1. An engine control system that is configured to control a work machine including an engine, a fuel injection device for injecting fuel into the engine, and a hydraulic pump driven by the engine, the engine control system comprising:

an operation amount acquisition unit that is configured to acquire an operation amount of a fuel injection amount adjustment device;

a target torque determination unit that is configured to determine a target torque according to the operation amount;

a rotation state amount specification unit that is configured to specify an inertia torque related to a structure including the engine and the hydraulic pump as a rotation state amount related to rotation of the engine;

an assist determination unit that is configured to determine a value of an assist torque corresponding to a magnitude of the inertia torque and determine whether or not to add the determined assist torque to the target torque based on the rotation state amount; and an injection amount determination unit that is configured to determine a fuel injection amount by the fuel injection device based on the rotation state amount;

wherein when a value of the inertia torque is less than a lower threshold value of a hysteresis related to an inertia torque threshold value, the injection amount determination unit calculates the fuel injection amount that adds the assist torque to the target torque.

2. The engine control system according to claim 1, further comprising:

an absorption torque specification unit that is configured to specify an absorption torque in the hydraulic pump, wherein the injection amount determination unit determines the fuel injection amount based on the absorption torque and the rotation state amount.

3. The engine control system according to claim 1, wherein the assist torque is an amount obtained by multiplying the rotation state amount by a predetermined coefficient.

4. A work machine comprising:

an engine;

a fuel injection device that is configured to inject fuel into the engine;

a hydraulic pump that is configured to be driven by the engine, and the engine control system according to claim 1.

5. A control method for a work machine including an engine, a fuel injection device that is configured to inject fuel into the engine, and a hydraulic pump that is configured to be driven by the engine, the method comprising the steps of:

acquiring an operation amount of a fuel injection amount adjustment device;

determining a target torque according to the operation amount;

specifying an inertia torque related to a structure including the engine and the hydraulic pump as a rotation state amount related to rotation of the engine;

determining a value of an assist torque corresponding to a magnitude of the inertia torque and determining whether or not to add the determined assist torque to the target torque based on the rotation state amount; and determining a fuel injection amount by the fuel injection device based on the rotation state amount, wherein the fuel injection amount that adds the assist torque to the target torque is calculated when a value of the inertia torque is less than a lower threshold value of a hysteresis related to an inertia torque threshold value.

6. The engine control system according to claim 2, further comprising:

an operation amount acquisition unit that is configured to acquire an operation amount of a fuel injection amount adjustment device;

a target torque determination unit that is configured to determine a target torque according to the operation amount; and an assist determination unit that is configured to add a predetermined assist torque to the target torque when the rotation state amount is less than a predetermined threshold value, wherein the injection amount determination unit converts the target torque into the fuel injection amount.

7. The engine control system according to claim 6, wherein the assist torque is an amount obtained by multiplying the rotation state amount by a predetermined coefficient.

8. A work machine comprising:

an engine;

A work machine comprising:

a fuel injection device that is configured to inject fuel into the engine;

a hydraulic pump that is configured to be driven by the engine, and the engine control system according to claim 2.

9. A work machine comprising:

an engine;

a fuel injection device that is configured to inject fuel into the engine;

a hydraulic pump that is configured to be driven by the engine, and the engine control system according to claim 3.

10. The engine control system according to claim 1, wherein when a value of the inertia torque is equal to or higher than the inertia torque threshold value, the assist determination unit sets the assist torque to 0.

* * * * *